US006945085B1

(12) United States Patent
Goda

(10) Patent No.: US 6,945,085 B1
(45) Date of Patent: Sep. 20, 2005

(54) METHOD OF MAKING METAL CONTAINERS

(75) Inventor: Mark E. Goda, Greenville, PA (US)

(73) Assignee: CCL Container (Hermitage) Inc., Hermitage, PA (US)

( * ) Notice: Subject to any disclaimer, the term of this patent is extended or adjusted under 35 U.S.C. 154(b) by 102 days.

(21) Appl. No.: 10/686,383

(22) Filed: Oct. 15, 2003

Related U.S. Application Data

(60) Provisional application No. 60/418,621, filed on Oct. 15, 2002.

(51) Int. Cl.[7] ..... B21C 23/18
(52) U.S. Cl. ..... 72/267; 72/256; 72/379.4; 72/715; 413/1
(58) Field of Search ..... 72/254, 256, 267, 72/273, 347, 348, 349, 715; 220/608, 669, 220/906; 148/550, 689; 413/1, 69, 76

(56) References Cited

U.S. PATENT DOCUMENTS

| | | | | |
|---|---|---|---|---|
| 3,029,507 | A * | 4/1962 | Gaggini | 72/254 |
| 4,243,438 | A * | 1/1981 | Yanagida et al. | 148/689 |
| 4,854,149 | A * | 8/1989 | Porucznik et al. | 72/352 |
| 5,095,730 | A * | 3/1992 | Lauder | 72/347 |
| 5,572,893 | A * | 11/1996 | Goda et al. | 72/254 |
| 5,822,843 | A * | 10/1998 | Diekhoff et al. | 29/512 |
| 6,627,012 | B1 * | 9/2003 | Tack et al. | 148/690 |
| 6,779,677 | B2 * | 8/2004 | Chupak | 220/288 |

* cited by examiner

*Primary Examiner*—Ed Tolan
(74) *Attorney, Agent, or Firm*—Michael Best & Friedrich LLP

(57) ABSTRACT

Lightweight metal containers are formed from high-strength metal alloys by impact extrusion of a cup-shaped container having a substantially larger diameter than the finished container, drawing and wall ironing the extruded container to reduce its diameter and wall thickness while increasing the height of the container to the appropriate diameter, wall thickness and height.

47 Claims, 6 Drawing Sheets

METHOD OF MAKING METAL CONTAINERS

This application claims priority of provisional Application Ser. No. 60/418,621 filed on Oct. 15, 2002.

FIELD OF THE INVENTION

The present invention relates to a method and apparatus for forming lightweight impact extruded metal containers.

BACKGROUND OF THE INVENTION

Metal containers, such as aluminum beverage and aerosol containers, are typically formed by impact extrusion or by cupper/bodymaker methods. Impact extruded metal containers are formed by plastic deformation of a disk-shaped metal slug into a cylindrical container having approximately the same height, diameter, base thickness and wall thickness as the finished container. The metal slug is placed at the bottom of a cylindrical die and struck with a high-speed cylindrical punch. The impact causes the metal slug to flow backward along the punch to form the extruded cylindrical container.

The extruded container is wall ironed to the diameter and wall thickness of the finished container, by placing the container over a cylindrical ironing punch and passing the container through a ring of narrowing diameter. The reduction in diameter and thickness of the wall causes the container to increase in length. The wall ironed container is then trimmed to the appropriate height.

The trimmed, wall ironed container may then receive interior and exterior coatings, such as primers, lithography and lacquer. The top of the container may also be shaped to form a neck, by insertion into a series of neck forming dies, and then threaded, curled or otherwise shaped to receive a screw cap, aerosol nozzle or other closure. Further shaping operations may be applied to the body of the container, to form a grip or other design.

Because of the amount of work required to plastically deform the metal slug, it has been necessary to manufacture the containers using relatively soft metal alloys, such as 1000 series aluminum which has less than or equal to 1% impurities. The use of such soft aluminum alloys requires the container to be designed with a relatively thick wall and base, to provide sufficient strength when the containers are stacked or when the contents are pressurized. High strength alloys, such as 3000 series aluminum alloys, would permit the manufacture of relatively lightweight containers with significantly thinner walls and base, while providing sufficient strength to withstand the weight of stacked containers or internal pressurization. However, such high-strength alloys are difficult to form by impact extrusion, and cause excessive wear and replacement of extrusion tooling. Thus, it has not been economically feasible to produce metal containers using high-strength alloys by impact extrusion.

Thin-walled containers made of high-strength alloys are typically produced from coiled metal sheet stock using the cupper/bodymaker method. The thickness of the metal sheet is preselected to be the same as the base thickness of the finished container, thus avoiding the severe deformation of the metal required to form the container by the impact extrusion process. The metal coil is unwound and fed into a cupper, which stamps a round blank from the sheet. The blank is then pressed into a die to form a cup-shaped cylindrical container, that has a substantially larger diameter and is correspondingly shorter than the finished container.

Because the metal is not plastically deformed, the base thickness and wall thickness of the cup retains the thickness of the metal sheet stock.

The cup is transferred to a bodymaker, which performs a series of wall ironing operations to sequentially reduce the diameter and wall thickness, and increase the height of the container to its appropriate height, diameter and wall thickness. The wall ironed container is then trimmed, necked and finished as described above for impact extruded containers.

There are several drawbacks to using the cupper/bodymaker method in comparison to impact extrusion methods. In particular, additional space and equipment is required for storage and handling of the large, heavy metal coils used to produce the containers. Furthermore, the cupper/bodymaker equipment is specifically designed to produce containers having a particular diameter and height, and cannot efficiently be adapted to produce alternate size containers. Thus, each size container typically requires a separate cupper/bodymaker and production line.

In contrast, the metal slugs used in the impact extrusion method do not require special handling or storage and the extrusion equipment is readily adapted to produce different sized containers by simply changing the size of the metal slug, and/or the size of the extrusion die and punch. Furthermore, the thickness of the base of the container can be changed by controlling the force of the extrusion punch, whereas the cupper/bodymaker method is limited to producing containers having the same base thickness as the thickness of the metal sheet stock.

In addition, the cupper/bodymaker method uses materials less efficiently than the impact extrusion method. Once the blanks are stamped from the metal sheet stock by the cupper, the exhausted metal sheet must be recycled or scrapped. Thus, a significant portion of the material cost is not incorporated into the containers. Such costs are avoided by the impact extrusion method, which uses preformed metal slugs as the starting material. Furthermore, metal slugs are available in a broad range of sizes and alloys, and can be purchased in relatively small numbers from a wide range of suppliers, which allows production to be flexibly switched between small lots of different types of containers. In contrast, the metal coils used in the cupper/bodymaker method are only available in bulk quantities from a few suppliers, which restricts production to relatively large numbers of a single type of container.

Thus, there is a need for a method of producing metal containers that permits the use of high-strength metal alloys and that can readily be adapted to produce containers of different height and diameter.

SUMMARY OF THE INVENTION

These needs and other needs are satisfied by the present invention, which comprises a method of making lightweight containers from high-strength metal alloys. According to the inventive method, a metal slug formed of a high-strength alloy is impact extruded to form a cup-shaped container that has a substantially larger diameter and which is correspondingly shorter than the finished container. The extruded cup is then drawn to approximately the diameter of the finished container and the drawn container is wall ironed in one or more steps to reduce the diameter and wall thickness and increase the height of the container to the diameter, wall thickness and height of the finished container. The wall ironed container is then bottom formed and trimmed.

DETAILED DESCRIPTION OF INVENTION

Figure 1:
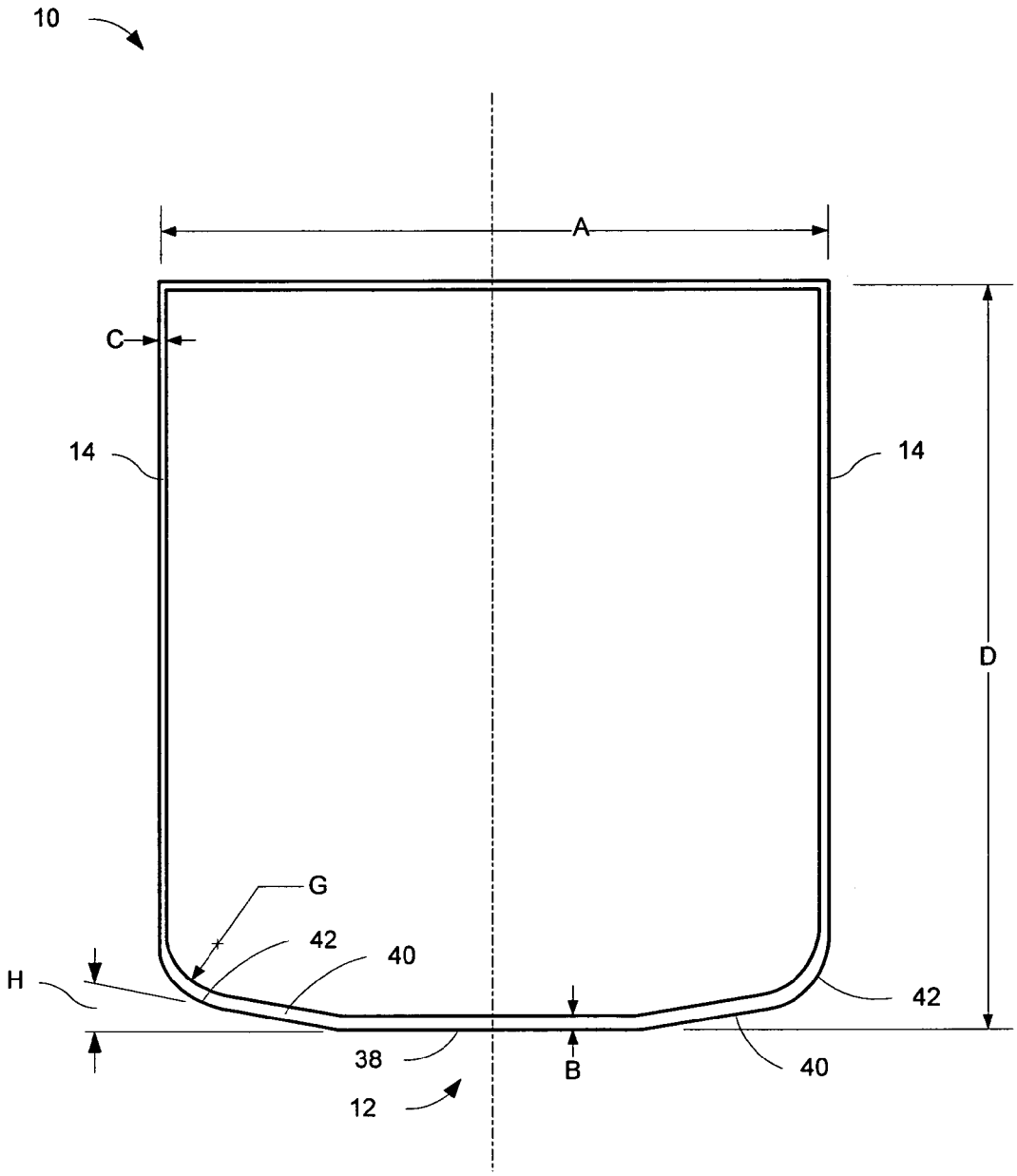
FIG. 1 is a vertical section view of the extruded cup-shaped container of the present invention.

In accordance with the present invention, a method of making thin-walled lightweight metal containers is described, comprising impact extruding a disk-shaped slug to form a cup-shaped cylindrical container that has a substantially larger diameter and shorter height than the finished container. The extruded cup is drawn to reduce the diameter and wall ironed to increase the height of the container to the approximate diameter and height of the finished container. Thus, much of the work performed by prior art impact extrusion processes is transferred to the drawing and wall ironing operations, which require less severe deformation of the container. The wall ironed container is then domed, trimmed and necked to produce the finished container.

The extrusion of a cup having a larger diameter and shorter height significantly reduces the amount of metal working that must be performed by the impact extrusion process in contrast to conventional methods of extrusion. In addition, the increase in diameter allows for a corresponding reduction in the thickness of the slug, which further reduces the work required by the impact extrusion process in comparison to the prior art. As a result, the present invention allows the impact extrusion of high-strength alloys with less stress to the extrusion tooling. The use of such high-strength alloys permits the design of lightweight containers having thinner walls, while maintaining or increasing the strength of the container.

FIG. 1 shows a cylindrical extruded cup 10 of the present invention, with a base 12 and walls 14. The dimensions of extruded cup 10 are determined as a function of the size of the finished container. In general, extruded cup 10 is designed to have an outer diameter A that is at least about 10% larger than the outer diameter of the finished container and preferably about 15% to about 25% larger than the outer diameter of finished container. The thickness B of base 12 of cup 10 preferably ranges from approximately 0.40 mm to 0.80 mm. Similarly, the thickness C of walls 14 of cup 10 preferably ranges from approximately 0.20 mm to 0.60 mm. The height D of cup 10 is dependent on the size of the extruded metal slug 16 (FIG. 2*a*) and may be calculated as a function of the cup diameter A, base thickness B and wall thickness C, in addition to other variables discussed herein. It will be understood by those of skill in the art that the dimensions of the extruded cup will vary in response to the size and type of metal alloy used to form the finished container.

In a most preferred embodiment, extruded cup 10 has an outer diameter A that is approximately 18% larger than the finished container, a base thickness B of approximately 0.60 mm, a wall thickness C of approximately 0.40 mm, and a resulting height that is roughly ½ the length of the finished container. However, it will be apparent to those of ordinary skill in the art that the preferred design of cup 10 will vary according to the size and function of the finished container.

Figure 2A:
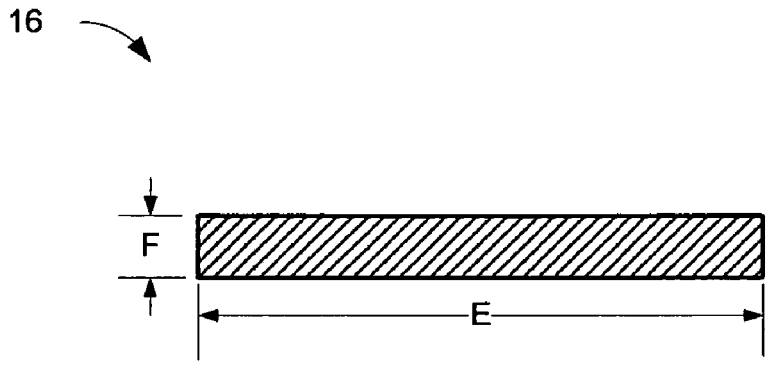
FIG. 2*a* is a vertical section view of the disk-shaped metal slug of the present invention.

Cup 10 is extruded from a disk-shaped metal slug 16, as shown in FIG. 2*a*. The mass of slug 16 is calculated or empirically determined to form a container of sufficient length to allow approximately 10–20 mm to be trimmed from the top of the wall ironed, domed container, as described below. In general, slug 16 has a diameter E that is slightly smaller than outer diameter A of cup 10 and has a thickness F that ranges from approximately 2.0–4.0 mm. In contrast, conventional slugs are typically 50–100% thicker than the slugs used in the present invention. In a preferred embodiment, slug 16 has a diameter E that is approximately 0.350 mm smaller than diameter A of the cup 10, and a thickness F that is approximately 2.50 mm. It will be apparent to those of skill in the art that the mass and dimensions of slug 16, are interrelated with outer diameter A of cup 10, and must be taken into account when designing the configuration of cup 10.

Slug 16 is preferably formed from high-strength alloys such 3000 series aluminum alloys—e.g. 3002, 3102, 3003, 3103, 3203, 3004, 3104, 3204, 3005, 3105, 3006, 3007, 3107, 3307, 3009, 3010, 3011, 3012, 3013, 3014, 3015, 3016, 3017, 3019, 3020, 3025 and 3030, among others. Other materials may also be used, such as 6000 series aluminum alloys, steel and other metal alloys that are conventionally difficult to extrude. Those of skill on the art will appreciate that the present invention may also be adapted to use conventional materials, such as 1000 series aluminum alloys—e.g. 1050, 1060, 1070 and 1100.

Figure 3:
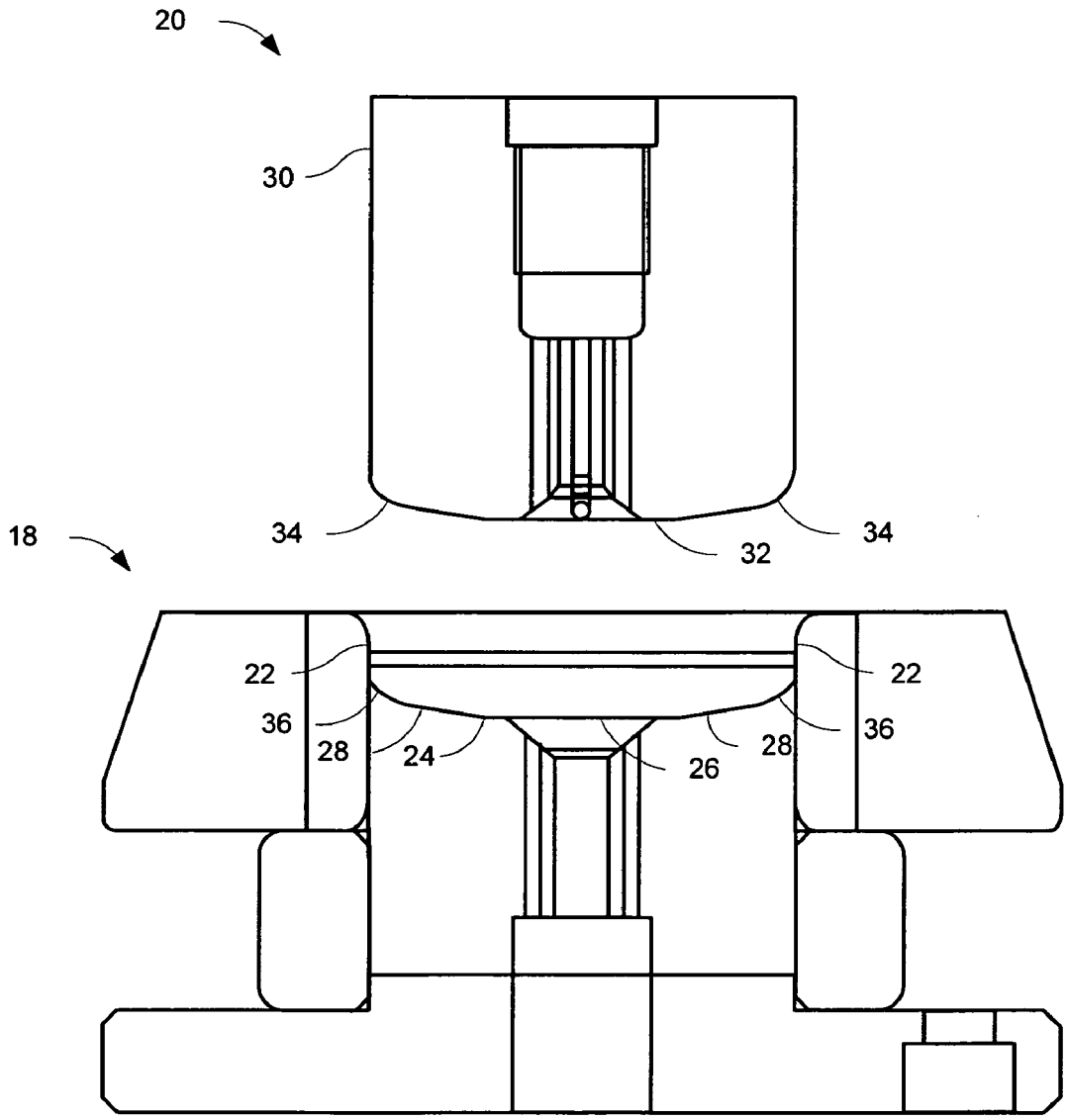
FIG. 3 is a vertical section view of the extrusion die and extrusion punch of the present invention.

FIG. 3 shows an extrusion die 18 and extrusion punch 20 for impact extrusion of cup 10. Extrusion die and punch 18, 20 are adapted for use in conventional extrusion systems. Extrusion die 18 has a cylindrical interior wall 22 and a bottom surface 24. Interior wall 22 of extrusion die 18 has a diameter that is equivalent to outer diameter A of cup 10. Bottom surface 24 of extrusion die 18 comprises a flat, circular central portion 26 with a conical outer ring 28. The angle of conical outer ring 28 ranges from approximately 1° to 15° relative to central portion 26.

Extrusion punch 20 has a cylindrical outer surface 30 and a face 32, which have a complementary configuration to interior wall 22 and bottom surface 24 of die 18. The diameter of outer surface 30 is smaller than the diameter of interior wall 22, by twice the wall thickness C of extruded cup 10. The configuration of face 32 mirrors the configuration of bottom surface 24 of extrusion die 18. The transition 34 between outer surface 30 and face 32 is a curve with a radius of approximately 3.0–8.0 mm. Die 18 has a complementary transition curve 36 between interior wall 22 and bottom surface 24.

Figure 4A:
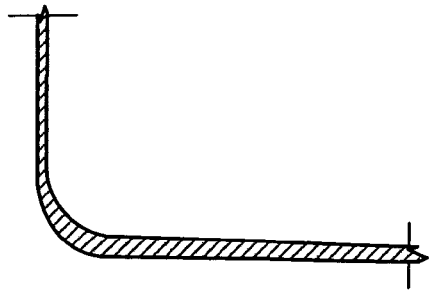
Figure 4A (Prior Art)
FIG. 4*a* is a detail section view of the corner of a prior art cylindrical extruded container.
Figure 4B:
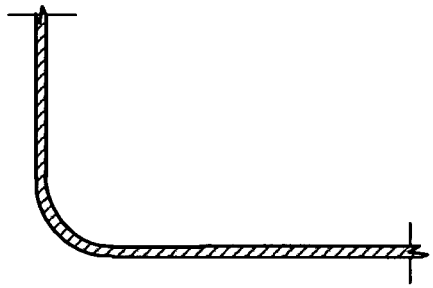
FIG. 4*b* is a detail section view of the corner of an embodiment of the extruded cup of the present invention.
Figure 4C:
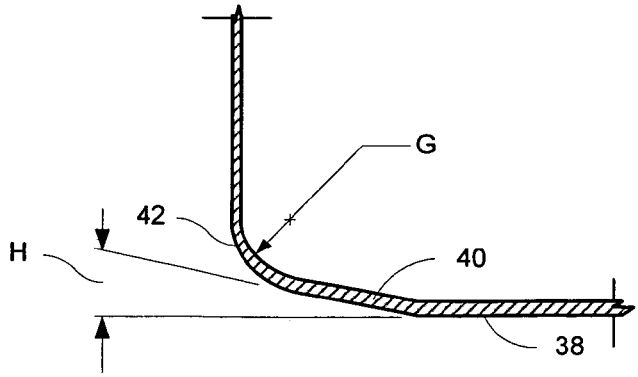
FIG. 4*c* is a detail section view of the corner of the extruded cup of FIG. 2.

As shown in FIGS. 1 and 4*c*, cup 10 has a base 12 shaped like an inverted, truncated cone, formed by cooperation of extrusion die and punch 18, 20. Conical base 12 has a flat, circular central portion 38 with a conical outer ring 40 that respectively correspond to circular central portion 26 and conical outer ring 28 of extrusion die 18. The corner 42 at base 12 of cup 10 is a curve with an interior radius G determined by the radius of transition 34 of extrusion punch 20. The conical shape of base 12 further decreases the amount of work required during impact extrusion by increasing the angle of corner 42 between base 12 and wall 14. In contrast, prior art containers are designed with a flat base which forces the extruded metal to flow through a relatively sharp angle, as shown in FIG. 4*a*.

In a preferred embodiment, extrusion die and punch 18, 20 are designed to produce a cup 10 with a conical base 12, having an angle H of approximately 1° and an inner radius G of approximately 6.600 mm. However, it will be apparent to those of ordinary skill in the art that the preferred angle H and radius G will vary according to the size of the finished container.

In the alternative embodiment shown in FIG. 4*b*, base 12 is flat and cup 10 has a uniform base thickness and wall thickness. This simplified configuration eliminates the need to manage the transition between the different wall thickness and base thickness of the container as described below.

Figure 2B:
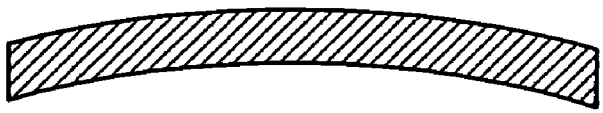
FIG. 2*b* is a vertical section view of a disk-shaped metal slug having a domed shaped.

Further steps may be taken to facilitate the impact extrusion process. In an alternative embodiment, the slug 16 is coated with a lubricant and/or preheated prior to impact extrusion. In yet another embodiment, slug 16 may be provided in a shape that is more conducive to forming, such as a domed shape shown in FIG. 2*b* which has a configuration similar to the conical configuration of extrusion die and punch 18, 20.

Figure 5:
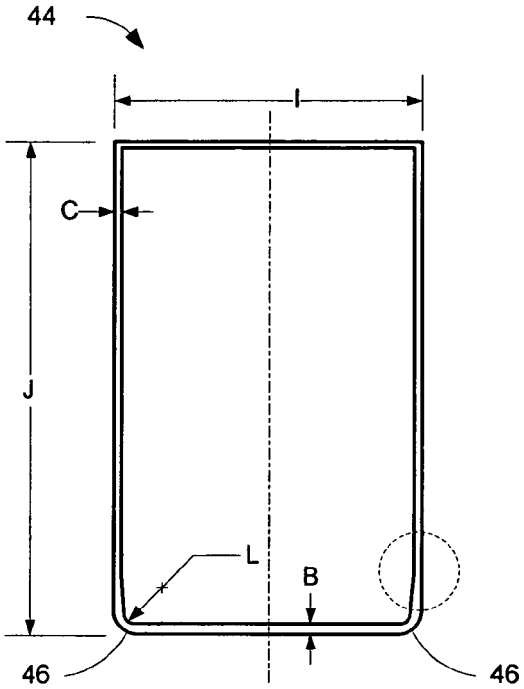
FIG. 5 is a vertical section view of the drawn cup of the present invention.

Cup 10 is subjected to a series of drawing and wall ironing operations to reduced the diameter and wall thickness, and increase the height of the extruded container to approximately the diameter, wall thickness and height of the finished container. As shown in FIG. 5, cup 10 is drawn through one or more dies (not shown) to reduce the diameter of the extruded container to a diameter I, that is approximately the diameter of the finished container. The drawing die and punch (not shown) are designed to maintain the extruded wall thickness C, throughout the drawing operation. The reduction in diameter causes the container to lengthen to a height J. Such drawing operations are well known in the art and may be performed using commercially available equipment.

Figure 6:
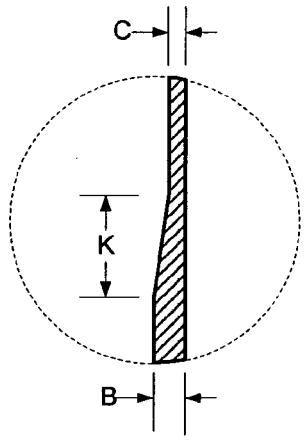
FIG. 6 is a detail section view showing the first transitional wall thickness adjacent the base of the drawn cup of FIG. 5.

The drawing punch is provided with a conical portion adjacent the face, to form a taper K in the wall thickness at the base of the drawn container 44, as shown in FIGS. 5 and 6. As best seen in FIG. 6, conical taper K has an angle of approximately 0.5° and creates a transition between base thickness B and extruded wall thickness C. The length of conical taper K will vary according to the difference between base thickness B and extruded wall thickness C.

Drawn container 44 is subsequently inserted into a first bottom forming die with a flat bottom (not shown), which cooperates with the flat face of the drawing punch to remove the conical shape of base 12. In addition, the bottom forming die and drawing punch are also designed to reduce the radius of corner 46 of drawn container 44 to the corner radius of the finished container. In a preferred embodiment, drawn container 44 is reduced to an outside diameter I that is less than approximately 1.0 mm larger than the diameter of the finished container.

Figure 7:
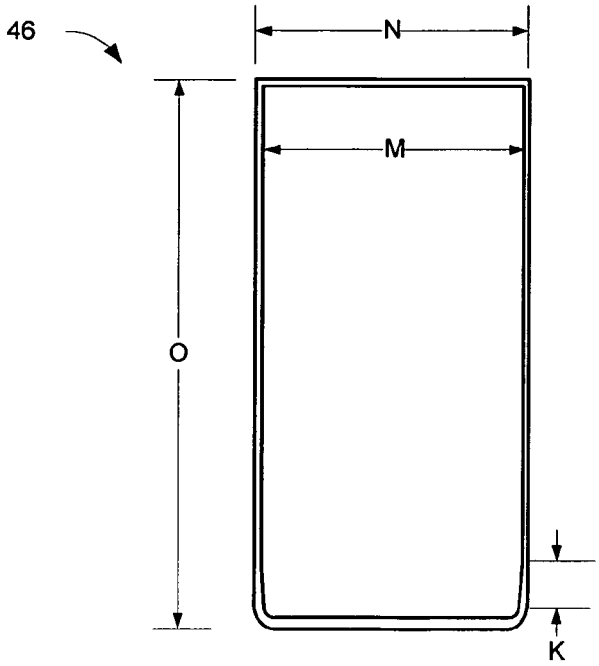
FIG. 7 is a vertical section view of the partially wall ironed, extruded container of the present invention.
Figure 8:
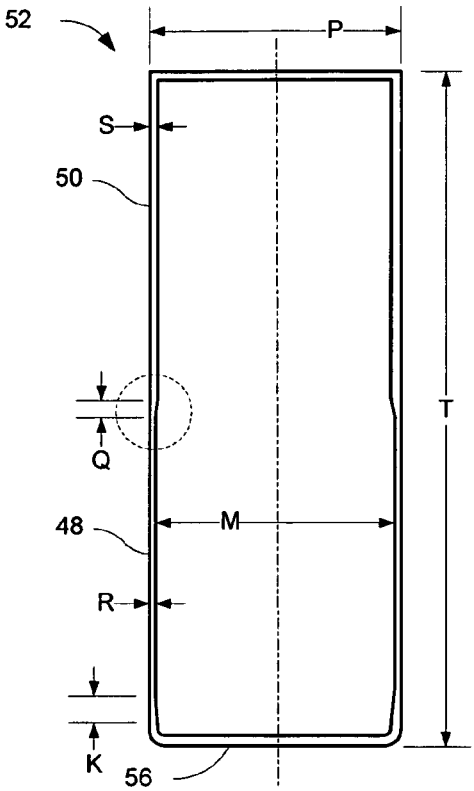
FIG. 8 is a vertical section view of the fully wall ironed, extruded container present invention.

The outer diameter I of drawn container 44 is reduced to the diameter of the finished container through a series of wall ironing operations, shown in FIGS. 7 and 8. A series of wall ironing operations is used to reduce the outer diameter I of drawn container 44 to the diameter of the finished container shown in FIGS. 7 and 8. Such wall ironing operations are well known in the art and involve forcing the container through one or more rings of narrowing diameter. The ironing ring and the ironing punch further cooperate to reduce the wall thickness of the container to the thickness of the finished container. The reduction in diameter and wall thickness causes the container to increase in length to the appropriate height. The wall ironing operations may be performed using commercially available wall ironing systems equipment such as that available from Frattini S.P.A. (Seriate, Italy), or bodymakers such as those available from Carnaud Metalbox (Shipley, West Yorkshire, England), Ragsdale (Englewood, Colo.) or Standun (Rancho Dominquez, Calif.).

The drawing punch and the first ironing punch (not shown) have the same configuration, with inner diameter M and conical taper K, as shown by comparison of the drawn and wall ironed containers depicted in FIGS. 6 and 7. The first ironing ring (FIG. 7, not shown) has an inner diameter N, which is approximately halfway between the outer diameter I of drawn container 44 and the outer diameter of the finished container. The resulting first ironed container has a configuration similar to that of drawn container 44, except that it has a slightly narrower outer diameter N and correspondingly increased length O.

Figure 9:
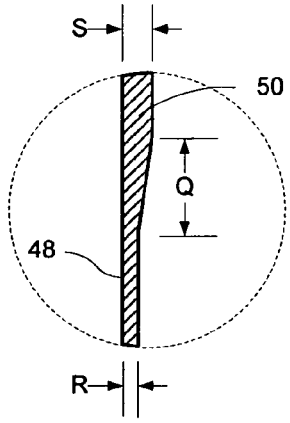
FIG. 9 is a detail section view of the second transitional wall thickness defining the top and bottom wall of the fully wall ironed, extruded container of FIG. 8.

The final ironing ring (not shown) has an inner diameter P that is identical to the outer diameter of the finished container, as shown by the wall ironed container depicted in FIG. 8. The final ironing punch (not shown) has a similar configuration to the drawing punch, but contains a second conical portion on its outer surface to form a taper Q in the wall thickness of the final ironed container 44. As best seen in FIG. 9, conical taper Q has an angle of approximately 0.5° and defines a transition between a bottom wall portion 48 with thickness R and a top wall portion 50 with thickness S. The length of conical taper Q will vary according to the difference between bottom wall thickness R and top wall thickness S. In addition to reducing the outside diameter and wall thickness of the container to the diameter and thickness of the finished container, the final ironing step also increases the height of the container to a length T, which is appropriate to accommodate the subsequent dome forming and trimming operations.

In a preferred embodiment conical taper Q begins approximately 90 mm from the base of the container. Bottom wall portion 48 is identical to the corresponding portion of drawn container 44, with interior diameter M and conical taper K. Wall thicknesses R and S range from 0.20–0.40 mm, top wall thickness S being greater than bottom wall thickness R to provide support for subsequent neck forming operations. In an alternative embodiment, the wall may have a uniform thickness without a taper Q.

Those of skill in the art will appreciate that the angle of tapers K and Q may vary according to size of the container and the metal alloy used to form the slug. In particular, taper Q results in a container having a bottom wall portion 48 with a larger interior diameter than the top wall portion 50. It will be understood by those of skill in the art that, if the angle of taper Q is too great and/or the metal alloy is relatively inflexible, then the wall ironed container may lock onto the ironing punch.

Figure 10:
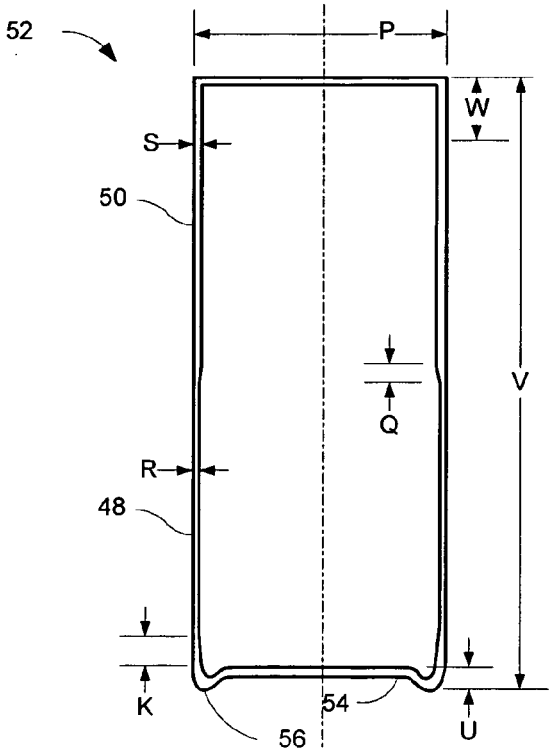
FIG. 10 is a vertical section view of the fully wall ironed, domed container of the present invention.

As shown in FIG. 10, the final wall ironed container 52 is inserted into a bottom forming die (not shown) to create a dome 54 with height U in the base 56 of the container. Dome 54 provides increased resistance to pressurized contents and ensures that base 56 provides a stable support for the container, as is well known in the art. In a preferred embodiment, height U of dome 54 is approximately 11.5 mm and reduces the container height T by approximately 3 mm, shown by length V.

As shown in FIG. 10, the top of domed container 58 is trimmed by approximately 10–20 mm, as shown by length W. This trimming step provides a smooth, even edge for subsequent finishing steps. As described above, the domed, trimmed container may then receive interior and exterior coatings and lithography, and is necked and provided with a closure as is well known in the art.

In addition to allowing the use of high-strength alloys, the present invention also increases the cold working of the metal by the multiple drawing and wall ironing steps. This additional cold working increases the material strength and complements the use of high-strength alloys to produce thin-walled containers. Furthermore, such cold working also increases the smoothness of the inner and outer surfaces of the finished container, which enhances the appearance of the container and the application of coatings and lithography.

The Example below is illustrative of the present invention for making thin-walled lightweight metal containers.

EXAMPLE

The following example describes the formation of an extruded, wall ironed and bottom formed cylindrical metal container having a diameter of 65.85 mm and a height of 166.0 mm, in accordance with the present invention. A cup 10 is formed by impact extrusion of disk-shaped metal slug 16 having a diameter E of 77.50 mm and a thickness F of 2.438 mm. The extrusion die 18 is cylindrical, with an interior wall 22 that is 77.85 mm in diameter. The bottom 24 of die 18 has a flat, circular central portion 26 having a diameter of 32 mm, and a conical outer ring 28 with an angle of 1°. The extrusion punch 20 is cylindrical, with an outer surface 30 that is 77.05 mm in diameter. The transition between outer surface 30 and face 32 of the extrusion punch is a curve 34 with a radius of 6.600 mm.

Metal slug 16 is placed in extrusion die 18 and struck by the extrusion punch with sufficient force to produce cup 10 having a bottom thickness B of 0.600 mm. The resulting cup 10 is cylindrical, with a diameter A of 77.85 mm, a wall thickness C of 0.400 mm and an average height D of approximately 87.88 mm. In addition, the base 12 of cup 10 is conical with a flat, circular central portion 38, that corresponds to the configuration of the bottom of extrusion die 18 and the face 32 of the extrusion punch 20. The corner of the cup has an interior radius G of 6.600 mm.

The extruded cup 10 is drawn to the approximate diameter of the finished container, and then bottom formed to remove the conical shape of the base of the cup. The drawing die is cylindrical, with an inner diameter of 66.19 mm. The drawing punch is also cylindrical, with an outer diameter of 65.39 mm, and has a conical segment at the end of the punch, adjacent to the face. The conical segment is 11.88 mm long and tapers from an outer diameter of 65.39 mm to a diameter of 64.99 mm. Thus, the drawing operation reduces the outer diameter I of the container from 77.85 mm to 66.19 mm, while maintaining the extruded wall thickness C of 0.400 mm. As a result, the average height of the container J is increased to approximately 109.78 mm. In addition, the conical segment of the drawing punch forms a taper K in the wall thickness adjacent the base of the container from 0.400 mm at the body of the container to 0.600 at the base of the container.

The drawn container 44 is subsequently inserted into a bottom forming die with a flat bottom, to remove the conical shape of the base 12 of cup 10 and to reduce the corner 46 of the container to its final radius. The face of the drawing punch mirrors the configuration of the bottom of the bottom forming die. The transition between the outer surface and face of the drawing punch is a curve with a radius of 3.000 mm. Thus, the bottom forming operation reduces the interior radius L at the corner of the container from 6.600 mm to its final radius of 3.000 mm.

The drawn container 44 is wall ironed in stages to reduce the diameter and wall thickness of the container to its final diameter and thickness. The drawn container 44 is passed through a first ironing ring with an inner diameter of 66.07 mm. The configuration and dimension of the corresponding first ironing punch are identical to the drawing punch. Thus, the first wall ironing operation reduces the outer diameter N of the drawn container from 66.19 mm to 66.07 mm. In addition, the wall thickness of the container is reduced from 0.400 mm to 0.340 mm, with a taper K in the wall thickness adjacent the base of the container from 0.340 mm at the body of the container to 0.540 mm at the base of the container. As a result of the first wall ironing operation, the average height O of the container is increased from 109.78 mm to a length of approximately 135.34 mm.

The container is then passed through a second ironing ring to reduce the diameter and wall thickness of the container to its final diameter and wall thickness. The second ironing ring has an inner diameter of 65.85 mm. In contrast to the previously described punches, the second ironing punch is conically shaped to produce a container with different top and bottom wall thicknesses. The second ironing punch has the same configuration and dimensions as the first ironing punch (and drawing punch), except that it contains a conical segment 5.7 mm long, which begins 90 mm from the face of the ironing punch and tapers from an outer diameter of 65.39 mm to a diameter of 65.29 mm. Thus, the second wall ironing operation reduces the outer diameter of the container P from 66.07 mm to its final diameter of 65.850 mm. In addition the wall thickness of the container is reduced from 0.340 mm to a bottom wall 48 thickness of 0.230 mm and a top wall 50 thickness of 0.280 mm. The taper K at the base of the container is also reduced in wall thickness, varying from 0.230 mm at the body of the container to 0.430 mm at the base of the container. As a result of the second wall ironing operation, the average height T of the container is increased from 135.34 mm to a length of approximately 180.0 mm.

The wall ironed container is inserted into a second bottom forming die to form a dome 54 in the base of the container. As the bottom forming die forces the metal at the base of the container upward to form dome, the walls of the container are drawn down toward the base causing a reduction in the height of the container. It has been empirically determined that a dome height of 11.50 mm reduces the height of the container by approximately 3.0 mm. Thus, the dome forming operation produces a container with an average height of approximately 177.0 mm which is approximately 11 mm longer than the 166 mm finished height of the container. This extra length allows the top of extruded, ironed container 52 to be trimmed to its final length, thereby removing any imperfections at the end of the container and providing a smooth even edge for subsequent finishing steps.

It will be apparent to those skilled in the art that modifications may be made without departing from the spirit and scope of the invention.

What is claimed is:

1. A method of making a finished thin-walled metal container using a high-strength alloy, comprising the steps of:

(a) providing a metal slug;

(b) impact extruding said metal slug to form a cylindrical cup having a base with a base thickness, walls with an outer diameter and wall thickness, and an open end opposite said base, said base thickness of said cup being about the thickness of the base of the finished container and said outer diameter being at least about 10% larger than the outer diameter of the finished container;

(c) drawing said impact extruded cup through at least one drawing die to reduce said outer diameter to about the outer diameter of the finished container without substantially reducing said wall thickness of said extruded cup; and (d) wall ironing said drawn cup through at least one wall ironing ring to reduce said outer diameter and said wall thickness of said drawn cup to the outer diameter and wall thickness of the finished container.

2. The method of claim 1, further comprising the step of heating the metal slug prior to said impact extrusion step.

3. The method of claim 1, wherein said metal slug is made of an aluminum alloy selected from the group consisting of: 3002, 3102, 3003, 3103, 3203, 3004, 3104, 3204, 3005, 3105, 3006, 3007, 3107, 3307, 3009, 3010, 3011, 3012, 3013, 3014, 3015, 3016, 3017, 3019, 3020, 3025 and 3030 aluminum alloys.

4. The method of claim 1, wherein said metal slug is made of a 6000 series aluminum alloy.

5. The method of claim 1, wherein said metal slug is disk-shaped, having a diameter that is about 0.35 mm smaller than the outer diameter of the impact extruded cup and a thickness of about 2.0 mm to about 4.0 mm.

6. The method of claim 1, wherein said metal slug is further provided with a domed shape.

7. The method of claim 1, wherein said impact extruded cup has an outer diameter that is about 15% to about 25% larger than the outer diameter of the finished container.

8. The method of claim 1, wherein said impact extruded cup has a base thickness of about 0.4 mm to about 0.8 mm, an outer diameter that is about 18% larger than the outer diameter of the finished container, and a wall thickness of about 0.2 mm to about 0.6 mm.

9. The method of claim 1, wherein said impact extruded cup further comprises a transition between said base and said walls, said transition being a circular curve with a radius of about 3.0 mm to about 8.0 mm.

10. The method of claim 1, wherein said base of said impact extruded cup comprises a flat central portion with a conical outer ring, said conical outer ring having an angle of about 1° to about 15° relative to said central portion.

11. The method of claim 1, wherein said drawing step further comprises forming a conical taper in said wall of said drawn cup adjacent said base.

12. The method of claim 11, wherein said conical taper has an angle of about 0.5°.

13. The method of claim 1, further comprising the step of inserting said drawn cup into at least one bottom forming die to form the base of said drawn cup into the shape of the base of the finished container.

14. The method of claim 1, wherein the wall of said wall ironed container further comprises a first wall thickness adjacent said base, a second wall thickness distal to said base, and a conical taper forming a transition between said first and second wall thicknesses.

15. The method of claim 14, wherein said first and second wall thicknesses are about 0.2 mm to about 0.4 mm, said second wall thickness being greater than said first wall thickness, and said conical taper has an angle of about 0.5°.

16. The method of claim 15, wherein said conical taper begins about 90 mm from the base of the wall ironed cup.

17. The method of claim 1, further comprising the step:

(e) trimming said open end of said wall ironed container to form a smooth even edge.

18. The method of claim 17, wherein about 10 mm to about 20 mm is trimmed from said open end of said wall ironed container.

19. A method of making a finished thin-walled metal container using a high-strength alloy, comprising the steps of:

(a) providing a disk-shaped metal slug;

(b) impact extruding said metal slug to form a cylindrical cup having a base with a base thickness, walls with an outer diameter and wall thickness, and an open end opposite said base, and wherein said base comprises a flat central portion with a conical outer ring, the angle of said conical ring ranging from about 1° to about 15° relative to said central portion, said base thickness of said cup being about the thickness of the base of the finished container and said outer diameter being at least about 10% larger than the outer diameter of the finished container;

(c) drawing said impact extruded cup through at least one drawing die to reduce said outer diameter to about the outer diameter of the finished container, without substantially reducing said wall thickness of said extruded cup;

(d) inserting said drawn cup into at least one bottom forming die to form the base of said drawn cup into the shape of the base of the finished container;

(d) wall ironing said bottom formed cup through at least one wall ironing ring to reduce said outer diameter and said wall thickness of said drawn cup to the outer diameter and wall thickness of the finished container; and (e) trimming said open end of said wall ironed container to form a smooth even edge.

20. The method of claim 19, further comprising the step of heating the metal slug prior to said impact extrusion step.

21. The method of claim 19, wherein said metal slug is made of an aluminum alloy selected from the group consisting of: 3002, 3102, 3003, 3103, 3203, 3004, 3104, 3204, 3005, 3105, 3006, 3007, 3107, 3307, 3009, 3010, 3011, 3012, 3013, 3014, 3015, 3016, 3017, 3019, 3020, 3025 and 3030 aluminum alloys.

22. The method of claim 19, wherein said metal slug is made of a 6000 series aluminum alloy.

23. The method of claim 19, wherein said metal slug has a diameter that is about 0.35 mm smaller than the outer diameter of the impact extruded cup and a thickness of about 2.0 mm to about 4.0 mm.

24. The method of claim 19, wherein said metal slug is further provided with a domed shape.

25. The method of claim 19, wherein said impact extruded cup has an outer diameter that is about 15% to about 25% larger than the outer diameter of the finished container.

26. The method of claim 19, wherein said impact extruded cup has a base thickness of about 0.4 mm to about 0.8 mm, an outer diameter that is about 18% larger than the outer diameter of the finished container, and a wall thickness of about 0.2 mm to about 0.6 mm.

27. The method of claim 19, wherein said impact extruded cup further comprises a transition between said base and said walls, said transition being a circular curve with a radius of about 3.0 mm to about 8.0 mm.

28. The method of claim 19, wherein said drawing step further comprises forming a conical taper in said wall of said drawn cup between said base thickness and said wall thickness.

29. The method of claim 28, wherein said conical taper has an angle of about 0.5°.

30. The method of claim 19, wherein the wall of said wall ironed container further comprises a first wall thickness adjacent said base, a second wall thickness distal to said base and a conical taper forming a transition between said first and second wall thicknesses.

31. The method of claim 30, wherein said first and second wall thicknesses range from about 0.2 mm to about 0.4 mm, said second wall thickness being greater than said first wall thickness, and said conical taper has an angle of about 0.5°.

32. The method of claim 31, wherein the conical taper begins about 90 mm from the base of the wall ironed cup.

33. The method of claim 19, wherein about 10 mm to about 20 mm is trimmed from said open end of said wall ironed container.

34. A method of making a finished thin-walled metal container using a high-strength alloy, comprising the steps of:

(a) providing a disk-shaped metal slug having a thickness of about 2.0 mm to about 4.0 mm;

(b) impact extruding said metal slug to form a cylindrical cup having a base with a base thickness, walls with an outer diameter and wall thickness, and an open end opposite said base, said base comprising a flat central portion with a conical outer ring, the angle of said conical ring being about 1° to about 15° relative to said central portion, said base thickness being about 0.4 mm to about 0.8 mm, said wall thickness being about 0.2 mm to about 0.6 mm, and said outer diameter being at least about 10% larger than the outer diameter of the finished container;

(c) drawing said impact extruded cup through at least one drawing die to reduce said outer diameter to about the outer diameter of the finished container, without substantially reducing said wall thickness of said extruded cup;

(d) inserting said drawn cup into at least one bottom forming die to form the base of said drawn cup into the shape of the base of the finished container;

(d) wall ironing said bottom formed cup through at least one wall ironing ring to reduce said outer diameter and said wall thickness of said drawn cup to the outer diameter and wall thickness of the finished container; and (e) trimming about 10 mm to about 20 mm from the open end of said wall ironed container to form a smooth even edge.

35. The method of claim 34, further comprising the step of heating the metal slug prior to said impact extrusion step.

36. The method of claim 34, wherein said metal slug has a diameter that is about 0.35 mm smaller than the outer diameter of said impact extruded cup and a thickness of about 2.0 mm to about 4.0 mm.

37. The method of claim 34, wherein said metal slug is further provided with a domed shape.

38. The method of claim 34, wherein said impact extruded cup has an outer diameter that is about 15% to about 25% larger than the outer diameter of the finished container.

39. The method of claim 34, wherein said impact extruded cup has an outer diameter that is about 18% larger than the outer diameter of the finished container.

40. The method of claim 34, wherein said metal slug is made of an aluminum alloy selected from the group consisting of: 3002, 3102, 3003, 3103, 3203, 3004, 3104, 3204, 3005, 3105, 3006, 3007, 3107, 3307, 3009, 3010, 3011, 3012, 3013, 3014, 3015, 3016, 3017, 3019, 3020, 3025 and 3030 aluminum alloys.

41. The method of claim 34, wherein said metal slug is made of a 6000 series aluminum alloy.

42. The method of claim 34, wherein said impact extruded cup further comprises a transition between said base and said walls, said transition being a circular curve with a radius of about 3.0 mm to about 8.0 mm.

43. The method of claim 34, wherein said drawing step further comprises forming a conical taper in said wall of said drawn cup adjacent said base.

44. The method of claim 43, wherein said conical taper has an angle of about 0.5°.

45. The method of claim 34, wherein the wall of said wall ironed container further comprises a first wall thickness adjacent said base, a second wall thickness distal to said base and a conical taper forming a transition between said first and second wall thicknesses.

46. The method of claim 45, wherein said first and second wall thicknesses range are about 0.2 mm to about 0.4 mm, said second wall thickness being greater than said first wall thickness, and said conical taper has an angle of about 0.5°.

47. The method of claim 46, wherein said conical taper begins about 90 mm from the base of the wall ironed cup.

* * * * *